US007518580B2

(12) United States Patent
Kwon

(10) Patent No.: US 7,518,580 B2
(45) **Date of Patent: *Apr. 14, 2009**

(54) LIGHT EMITTING DISPLAY, DISPLAY PANEL, AND DRIVING METHOD THEREOF

(75) Inventor: Oh-Kyong Kwon, Seoul (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 599 days.

This patent is subject to a terminal disclaimer.

(21) Appl. No.: 11/139,148

(22) Filed: May 27, 2005

(65) Prior Publication Data

US 2005/0265071 A1 Dec. 1, 2005

Related U.S. Application Data

(63) Continuation of application No. 10/729,256, filed on Dec. 4, 2003, now Pat. No. 6,919,871.

(30) Foreign Application Priority Data

Apr. 1, 2003 (KR) ..... 2003-0020432

(51) Int. Cl.
*G09G 3/30* (2006.01)

(52) U.S. Cl. ..... 345/76; 345/82; 345/84; 345/90; 345/92; 345/98

(58) Field of Classification Search ..... 345/76–100, 345/204–215; 315/169.1–169.4
See application file for complete search history.

(56) References Cited

U.S. PATENT DOCUMENTS 5,714,968 A 2/1998 Ikeda 6,229,506 B1 5/2001 Dawson et al.

(Continued)

FOREIGN PATENT DOCUMENTS

EP 1 220 191 A2 7/2002

(Continued)

OTHER PUBLICATIONS

European Patent Office, European Search Report, European Patent Application No. EP 03090385, Report, Oct. 21, 2004, 3 pages, Munich.

(Continued)

*Primary Examiner*—Vijay Shankar
(74) *Attorney, Agent, or Firm*—Christie, Parker & Hale, LLP

(57) ABSTRACT

A light emitting display for compensating for the threshold voltage of transistor or mobility and fully charging a data line. A transistor and first through third switches are formed on a pixel circuit of an organic EL display. The transistor supplies a driving current for emitting an organic EL element (OLED). The first switch diode-connects the transistor. A first storage unit stores a first voltage corresponding to a threshold voltage of the transistor. A second switch transmits a data current in response to a select signal. A second storage unit stores a second voltage corresponding to the data current. A third switch transmits the driving current to the OLED. A third voltage determined by coupling of the first and second storage units is applied to a transistor to supply the driving current to the OLED.

32 Claims, 10 Drawing Sheets

U.S. PATENT DOCUMENTS

| | | | | |
|---|---|---|---|---|
| 6,348,906 | B1 | 2/2002 | Dawson et al. | |
| 6,535,185 | B2 | 3/2003 | Kim et al. | |
| 6,542,142 | B2 | 4/2003 | Yumoto et al. | |
| 6,753,655 | B2 | 6/2004 | Shih et al. | |
| 6,859,193 | B1 | 2/2005 | Yumoto | |
| 6,919,871 | B2 * | 7/2005 | Kwon | 345/92 |
| 2001/0026251 | A1 | 10/2001 | Hunter et al. | |
| 2003/0132931 | A1 | 7/2003 | Kimura et al. | |

FOREIGN PATENT DOCUMENTS

| | | |
|---|---|---|
| EP | 1 220 191 A3 | 9/2003 |
| JP | 2003-177709 | 6/2003 |
| JP | 2004-310014 | 11/2004 |
| JP | 2005-62794 | 3/2005 |

OTHER PUBLICATIONS

Patent Abstracts of Japan, Publication No. 2004-310014, dated Nov. 4, 2004, in the name of Oh-Kyong Kwon.
Patent Abstracts of Japan, Publication No. 2003-177709, dated Jun. 27, 2003, in the name of Takashi Miyazawa.
Patent Abstracts of Japan, Publication No. 2005-062794, dated Mar. 10, 2005, in the name of Koji Numao.

* cited by examiner

LIGHT EMITTING DISPLAY, DISPLAY PANEL, AND DRIVING METHOD THEREOF

CROSS-REFERENCE TO RELATED APPLICATION(S)

This application is a continuation of U.S. patent application Ser. No. 10/729,256 filed Dec. 4, 2003, now U.S. Pat. No. 6,919,871 issued Jul. 19, 2005, which claims priority to and the benefit of Korea Patent Application No. 2003-20432 filed on Apr. 1, 2003 in the Korean Intellectual Property Office, the entire content of which is incorporated herein by reference.

BACKGROUND OF THE INVENTION (a) Field of the Invention

The present invention relates to a light emitting display, a display panel, and a driving method thereof. More specifically, the present invention relates to an organic electroluminescent (EL) display.

(b) Description of the Related Art

In general, an organic EL display electrically excites a phosphorous organic compound to emit light, and it voltage- or current-drives N×M organic emitting cells to display images. As shown in FIG. 1, the organic emitting cell includes an anode of indium tin oxide (ITO), an organic thin film, and a cathode layer of metal. The organic thin film has a multi-layer structure including an emitting layer (EML), an electron transport layer (ETL), and a hole transport layer (HTL) for maintaining balance between electrons and holes and improving emitting efficiencies, and it further includes an electron injecting layer (EIL) and a hole injecting layer (HIL).

Methods for driving the organic emitting cells include the passive matrix method, and the active matrix method using thin film transistors (TFTs) or metal oxide semiconductor field effect transistors (MOSFETs). The passive matrix method forms cathodes and anodes to cross with each other, and selectively drives lines. The active matrix method connects a TFT and a capacitor with each ITO pixel electrode to thereby maintain a predetermined voltage according to capacitance. The active matrix method is classified as a voltage programming method or a current programming method according to signal forms supplied for maintaining a voltage at a capacitor.

Referring to FIGS. 2 and 3, conventional organic EL displays of the voltage programming and current programming methods will be described.

FIG. 2 shows a conventional voltage programming type pixel circuit for driving an organic EL element, representing one of N×M pixels. Referring to FIG. 2, transistor M1 is coupled to an organic EL element (referred to as an OLED hereinafter) to thus supply current for light emission. The current of transistor M1 is controlled by a data voltage applied through switching transistor M2. In this instance, capacitor C1 for maintaining the applied voltage for a predetermined period is coupled between a source and a gate of transistor M1. Scan line $S_n$ is coupled to a gate of transistor M2, and data line Dm is coupled to a source thereof.

As to an operation of the above-configured pixel, when transistor M2 is turned on according to a select signal applied to the gate of switching transistor M2, a data voltage from data line Dm is applied to the gate of transistor M1. Accordingly, current $I_{OLED}$ flows to transistor M2 in correspondence to a voltage $V_{GS}$ charged between the gate and the source by capacitor C1, and the OLED emits light in correspondence to current $I_{OLED}$.

In this instance, the current that flows to the OLED is given in Equation 1.

$$I_{OLED}=\beta/2(V_{GS}-V_{TH})^2=\beta/2(V_{DD}-V_{DATA}-|V_{TH}|)^2 \quad \text{Equation 1}$$

where $I_{OLED}$ is the current flowing to the OLED, $V_{GS}$ is a voltage between the source and the gate of transistor M1, $V_{TH}$ is a threshold voltage at transistor M1, and β is a constant.

As given in Equation 1, the current corresponding to the applied data voltage is supplied to the OLED, and the OLED gives light in correspondence to the supplied current, according to the pixel circuit of FIG. 2. In this instance, the applied data voltage has multi-stage values within a predetermined range so as to represent gray.

However, the conventional pixel circuit following the voltage programming method has a problem in that it is difficult to obtain high gray because of deviation of a threshold voltage $V_{TH}$ of a TFT and deviations of electron mobility caused by non-uniformity of an assembly process. For example, in the case of driving a TFT of a pixel through 3 volts (3V), voltages are to be supplied to the gate of the TFT for each interval of 12 mV (=3V/256) so as to represent 8-bit (256) grays, and if the threshold voltage of the TFT caused by the non-uniformity of the assembly process deviates, it is difficult to represent high gray. Also, since the value β in Equation 1 changes because of the deviation of the mobility, it becomes even more difficult to represent the high gray.

On assuming that the current source for supplying the current to the pixel circuit is uniform over the whole panel, the pixel circuit of the current programming method can achieve uniform display features even though a driving transistor in each pixel has non-uniform voltage-current characteristics.

FIG. 3 shows a pixel circuit of a conventional current programming method for driving the OLED, representing one of N×M pixels. Referring to FIG. 3, transistor M1 is coupled to the OLED to supply the current for light emission, and the current of transistor M1 is controlled by the data current applied through transistor M2.

First, when transistors M2 and M3 are turned on because of the select signal from scan line $S_n$, transistor M1 becomes diode-connected, and the voltage matched with data current $I_{DATA}$ from data line Dm is stored in capacitor C1. Next, the select signal from scan line $S_n$ becomes high-level to turn on transistor M4. Then, the power is supplied from power supply voltage VDD, and the current matched with the voltage stored in capacitor C1 flows to the OLED to emit light. In this instance, the current flowing to the OLED is as follows.

$$I_{OLED}=\beta/2(V_{GS}-V_{TH})^2=I_{DATA} \quad \text{Equation 2}$$

where $V_{GS}$ is a voltage between the source and the gate of transistor M1, $V_{TH}$ is a threshold voltage at transistor M1, and β is a constant.

As given in Equation 2, since current $I_{OLED}$ flowing to the OLED is the same as data current $I_{DATA}$ in the conventional current pixel circuit, uniform characteristics can be obtained when the programming current source is set to be uniform over the whole panel. However, since current $I_{OLED}$ flowing to the OLED is a fine current, control over the pixel circuit by fine current $I_{DATA}$ problematically requires much time to charge the data line. For example, assuming that the load capacitance of the data line is 30 pF, it requires several milliseconds of time to charge the load of the data line with the data current of several tens to hundreds of nA. This causes a problem that the charging time is not sufficient in consideration of the line time of several tens of microseconds.

SUMMARY OF THE INVENTION

In accordance with the present invention a light emitting display is provided for compensating for the threshold voltage of transistors or for electron mobility, and sufficiently charging the data line.

In one aspect of the present invention, a light emitting display is provided that includes a display panel on which a plurality of data lines for transmitting the data current that displays video signals, a plurality of scan lines for transmitting a select signal, and a plurality of pixel circuits formed at a plurality of pixels defined by the data lines and the scan lines are formed. The pixel circuit includes: a light emitting element for emitting light corresponding to the applied current; a first transistor, having first and second main electrodes and a control electrode, for supplying a driving current for the light emitting element; a first switch for diode-connecting the first transistor in response to a first control signal; a first storage unit for storing a first voltage corresponding to a threshold voltage of the first transistor in response to a second control signal; a second switch for transmitting a data signal from the data line in response to the select signal from the scan line; a second storage unit for storing a second voltage corresponding to the data current from the first switch; and a third switch for transmitting the driving current from the first transistor to the light emitting element in response to a third control signal. A third voltage determined by coupling of the first and second storage units respectively storing the first and second voltages is applied to the first transistor to supply the driving current to the light emitting element. The second control signal is enabled, the select signal is enabled, and the third control signal is then enabled in order. The pixel circuit further includes a fourth switch turned on in response to the second control signal, and coupled to a control electrode of the first transistor. The second storage unit is formed by a first capacitor coupled between the control electrode and the first main electrode of the first transistor. The first storage unit is formed by parallel coupling of a second capacitor coupled between the first main electrode of the first transistor and a second end of the fourth switch, and the first capacitor. The second control signal is the select signal from the scan line, and the fourth switch responds in the disable interval of the select signal. The first control signal includes a select signal from the previous scan line and a select signal from the current scan line. The first switch includes a second transistor for diode-connecting the first transistor in response to the select signal from the previous scan line, and a third transistor for diode-connecting the first transistor in response to the select signal from the current scan line. The second control signal includes a select signal from the previous scan line, and the third control signal. The pixel circuit further includes a fifth switch coupled in parallel to the fourth switch. The fourth and fifth transistors are respectively turned on in response to the select signal from the previous scan line and the third control signal.

In another aspect of the present invention, a display panel of a light emitting display, on which a plurality of data lines for transmitting the data current that displays video signals, a plurality of scan lines for transmitting a select signal, and a plurality of pixel circuits formed at a plurality of pixels defined by the data lines and the scan lines are formed. The pixel circuit includes: a first transistor having a first main electrode coupled to a first power supplying a first voltage; a first switch coupled between a second main electrode of the first transistor and the data line, and being controlled by a first select signal from the scan line; a second switch controlled by a first control signal to diode-connect the first transistor; a third switch having a first end coupled to a control electrode of the first transistor, and being controlled by a second control signal; a fourth switch having a first end coupled to a second main electrode of the first transistor, and being controlled by a third control signal; a light emitting element, coupled between a second end of the fourth switch and a second power supplying a second voltage, for emitting light corresponding to the applied current; a first storage unit coupled between the control electrode and the first main electrode of the first transistor when the third switch is turned on; and a second storage unit coupled between the control electrode and the first main electrode of the first transistor when the third switch is turned off.

In still another aspect of the present invention, a method is provided for driving a light emitting display including a pixel circuit including a switch for transmitting a data current from a data line in response to a select signal from a scan line, a transistor including first and second main electrodes and a control electrode for outputting the driving current in response to the data current, and a light emitting element for emitting light corresponding to the driving current from the transistor. A first voltage corresponding to a threshold voltage of the transistor is stored in a first storage unit formed between the control electrode and the first main electrode of the transistor. A second voltage corresponding to the data current from the switch is stored in a second storage unit formed between the control electrode and the first main electrode of the transistor. The first and second storage units are coupled to establish the voltage between the control electrode and the first main electrode of the transistor as a third voltage. The driving current is transmitted from the transistor to the light emitting display, wherein the driving current from the transistor is determined corresponding to the third voltage.

In still yet another aspect of the present invention, a method is provided for driving a light emitting display including a pixel circuit including a switch for transmitting a data current from a data line in response to a select signal from a scan line, a transistor including first and second main electrodes and a control electrode for outputting the driving current in response to the data current, and a light emitting element for emitting light corresponding to the driving current from the transistor. The transistor is diode-connected in response to a first control signal. A first storage unit is coupled between the control electrode and the first main electrode of the transistor in response to a first level of a second control signal to store a first voltage corresponding to a threshold voltage of the transistor in the first storage unit. The transistor is diode-connected by the first control signal. A second storage unit is coupled between the control electrode and the first main electrode of the transistor in response to a second level of the second control signal. A second voltage corresponding to the data current is stored in the second storage unit in response to the first select signal. The first and second storage units are coupled in response to the first level of the second control signal to establish the voltage between the control electrode and the first main electrode of the transistor as a third voltage. A driving current is provided corresponding to the third voltage to the transistor. The driving current is provided to the light emitting element in response to a third control signal.

In a still further another aspect of the present invention, in a method for transmitting a data current showing video signals to a transistor in response to a first select signal to drive a light emitting element, a method for driving a light emitting display is provided. First and second control signals are established respectively applied to first and second switches as an enable level to store a first voltage corresponding to a threshold voltage of the transistor. A third control signal is established applied to a third switch as a disable level to electrically intercept the transistor and the light emitting element. The first select signal is established as a disable level to intercept the data current. The first select signal is established as an enable level to supply the data current. The first and second control signals are respectively established as enable and disable levels to store a second voltage corresponding to the data current. The first select signal is established as a disable level to intercept the data current. The first and second control signals are respectively established as disable and enable levels to apply a third voltage to a main electrode and a gate electrode of the transistor. The third control signal is established as an enable level to transmit the current from the transistor to the light emitting element, wherein the third voltage is determined by the first and second voltages.

DETAILED DESCRIPTION OF THE INVENTION

An organic EL display, a corresponding pixel circuit, and a driving method thereof will be described in detail with reference to drawings.

Figure 1:
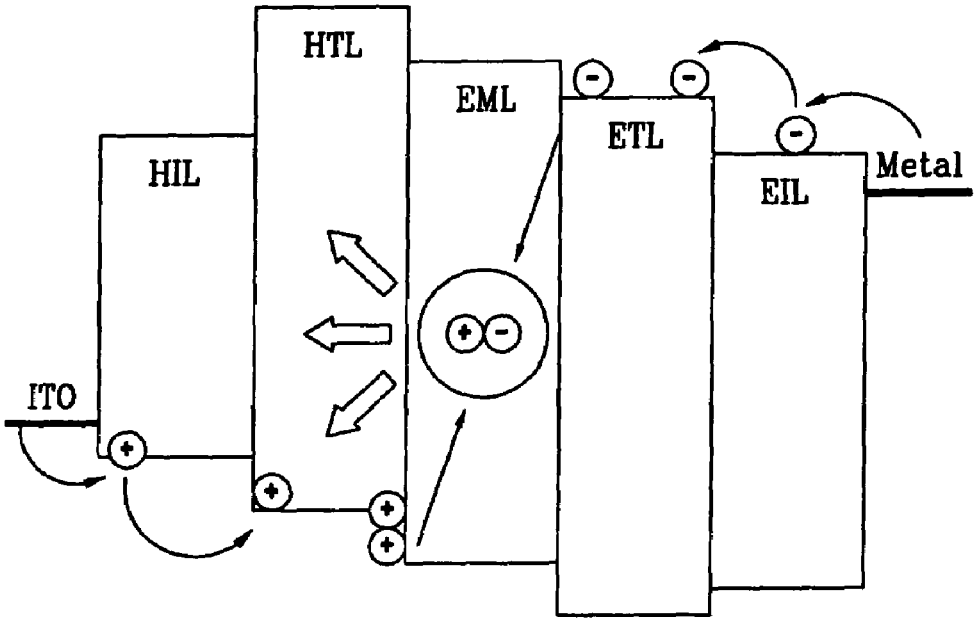
FIG. 1 shows a concept diagram of an OLED.
Figure 2:
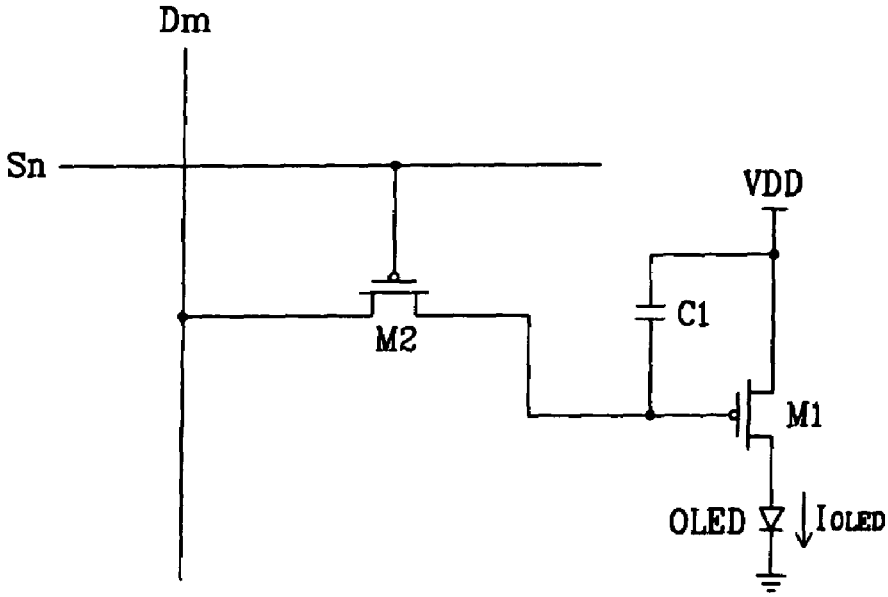
FIG. 2 shows an equivalent circuit of a conventional pixel circuit following the voltage programming method.
Figure 3:
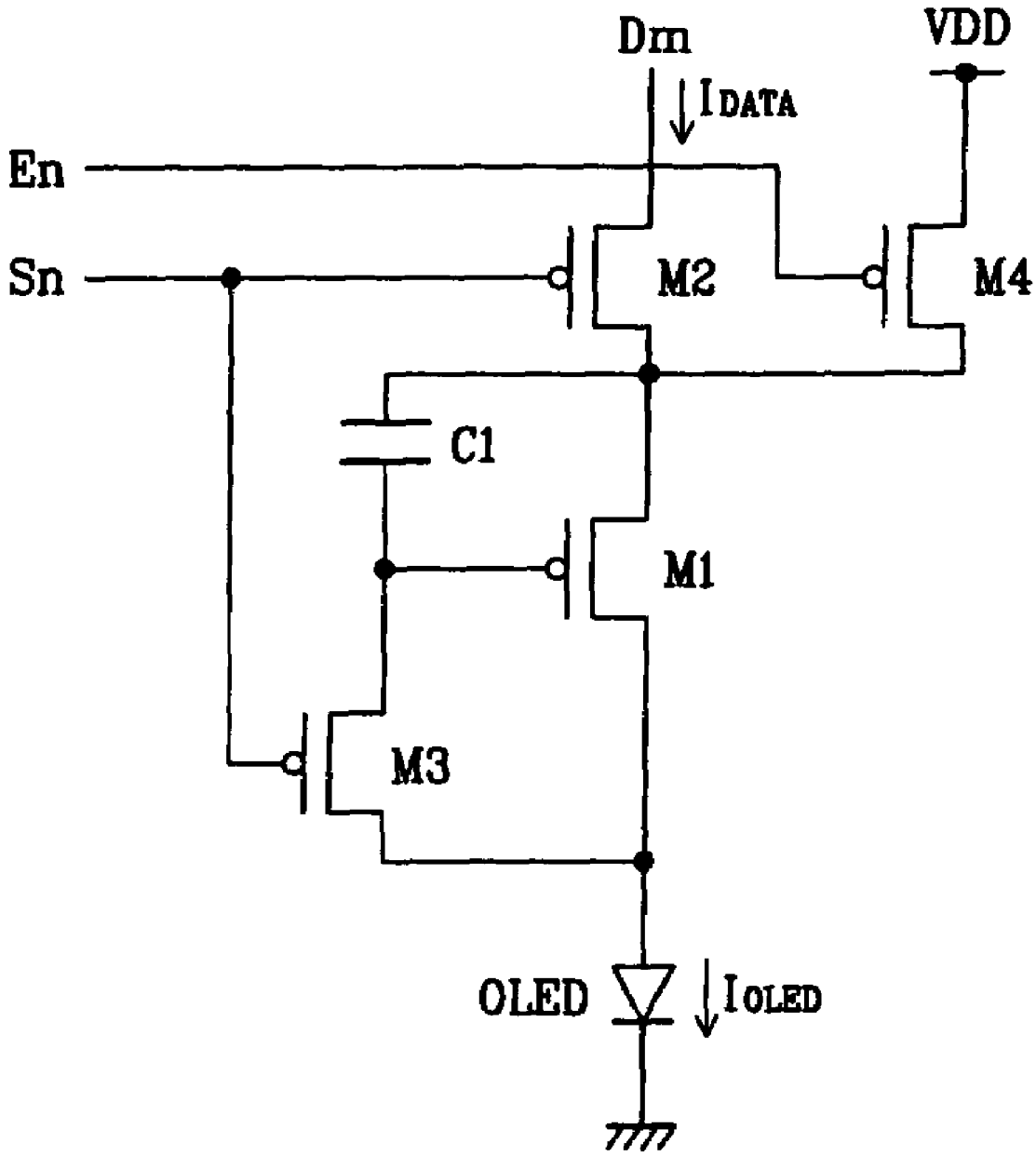
FIG. 3 shows an equivalent circuit of a conventional pixel circuit following the current programming method.
Figure 4:
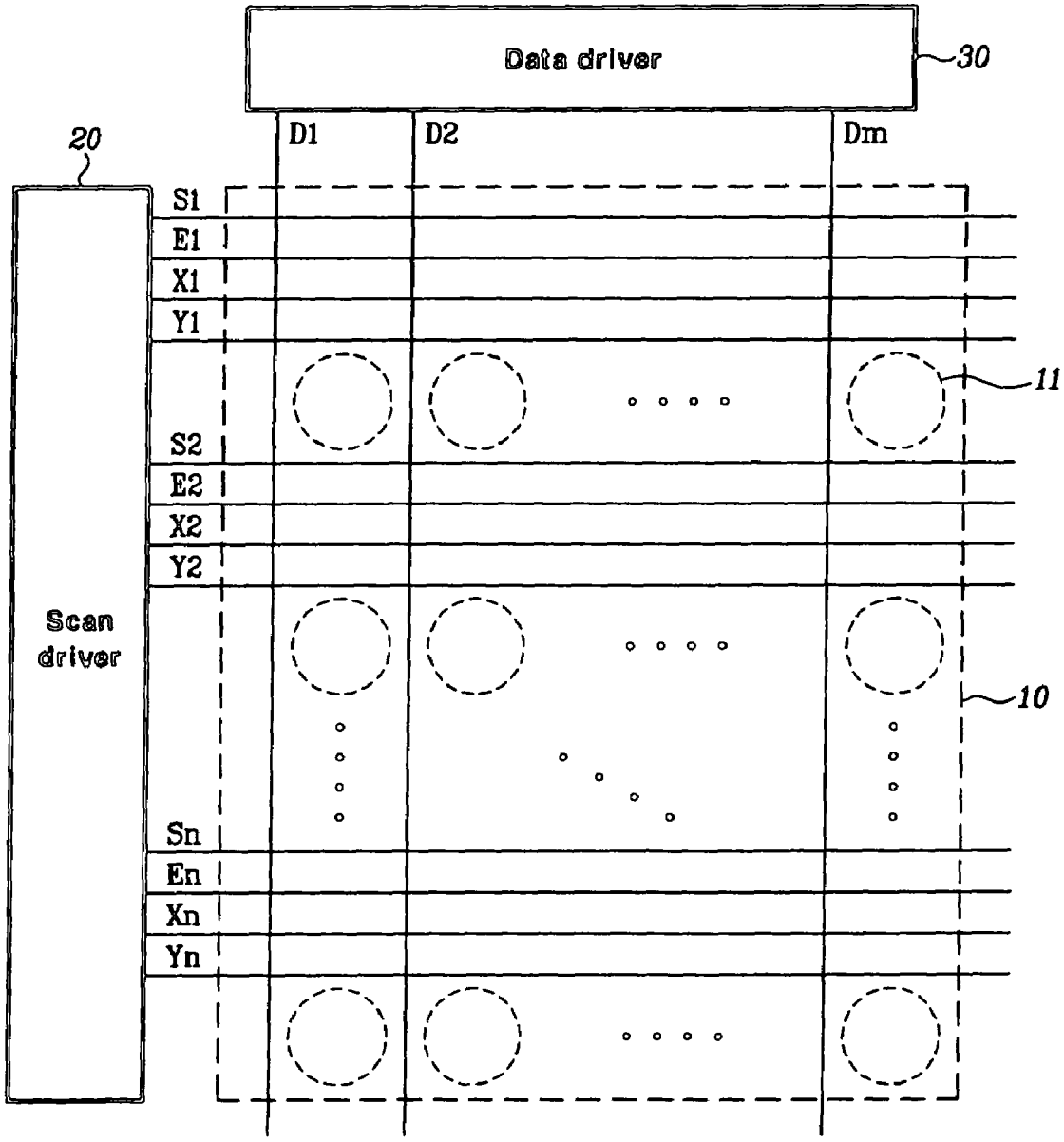
FIG. 4 shows a brief plane diagram of an organic EL display according to an embodiment of the present invention, FIGS. 5, 7, 9, 11, 13, 14, and 15 respectively show an equivalent circuit of a pixel circuit according to first through seventh embodiments of the present invention.

First, referring to FIG. 4, the organic EL display will be described. FIG. 4 shows a brief ground plan of the OLED.

As shown, the organic EL display includes organic EL display panel 10, scan driver 20, and data driver 30.

Organic EL display panel 10 includes a plurality of data lines $D_1$ through $D_m$ in the row direction, a plurality of scan lines $S_1$ through $S_n$, $E_1$ through $E_n$, $X_1$ through $X_n$, and $Y_1$ through $Y_n$, and a plurality of pixel circuits 11. Data lines $D_1$ through $D_m$ transmit data signals that represent video signals to pixel circuit 11, and scan lines $S_1$ through $S_n$ transmit select signals to pixel circuit 11. Pixel circuit 11 is formed at a pixel region defined by two adjacent data lines $D_1$ through $D_m$ and two adjacent scan lines $S_1$ through $S_n$. Also, scan lines $E_1$ through $E_n$ transmit emit signals for controlling emission of pixel circuits 11, and scan lines $X_1$ through $X_n$ and $Y_1$ through $Y_n$ respectively transmit control signals for controlling operation of pixel circuits 11.

Scan driver 20 sequentially applies respective select signals and emit signals to scan lines $S_1$ through $S_n$ and $E_1$ through $E_n$, and control signals to scan lines $X_1$ through $X_n$ and $Y_1$ through $Y_n$. Data driver 30 applies the data current that represents video signals to data lines $D_1$ through $D_m$.

Scan driver 20 and/or data driver 30 can be coupled to display panel 10, or can be installed, in a chip format, in a tape carrier package (TCP) coupled to display panel 10. The same can be attached to display panel 10, and installed, in a chip format, on a flexible printed circuit (FPC) or a film coupled to display panel 10, which is referred to as a chip on flexible (CoF) board, or chip on film method. Differing from this, scan driver 20 and/or data driver 30 can be installed on the glass substrate of the display panel, and further, the same can be substituted for the driving circuit formed in the same layers of the scan lines, the data lines, and TFTs on the glass substrate, or directly installed on the glass substrate, which is referred to as a chip on glass (CoG) method.

Figure 5:
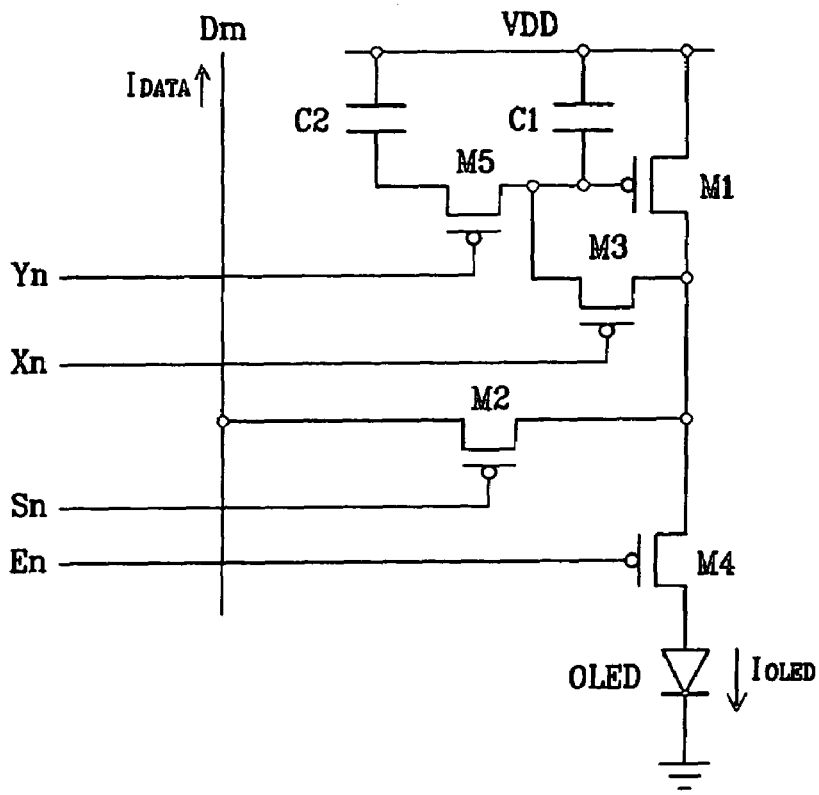
Figure 6:
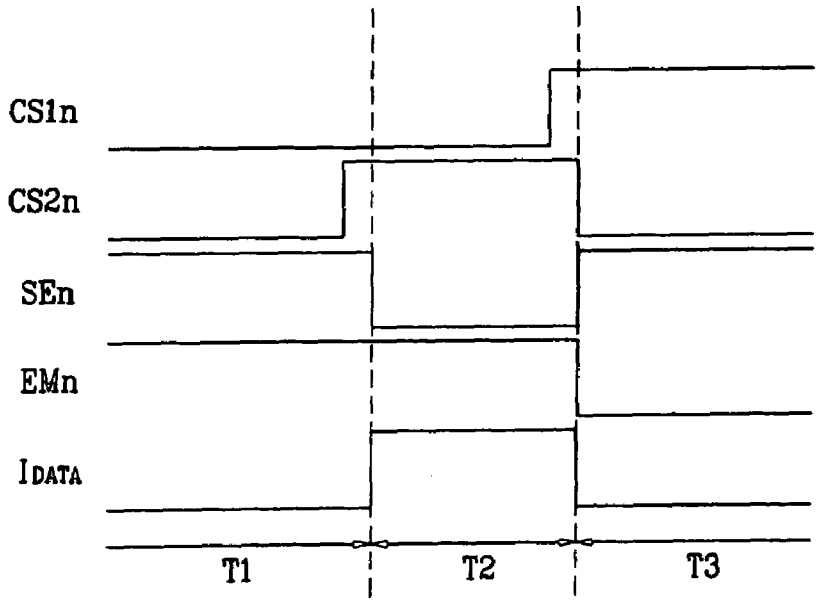
FIGS. 6, 8, 10, 12, and 16 respectively show a driving waveform for driving the pixel circuit of FIGS. 5, 7, 9, 11, and 15.

Referring to FIGS. 5 and 6, pixel circuit 11 of the organic EL display according to the first embodiment of the present invention will now be described. FIG. 5 shows an equivalent circuit diagram of the pixel circuit according to the first embodiment, and FIG. 6 shows a driving waveform diagram for driving the pixel circuit of FIG. 5. In this instance, for ease of description, FIG. 5 shows a pixel circuit coupled to an m-th data line $D_m$ and an n-th scan line $S_n$.

As shown in FIG. 5, pixel circuit 11 includes an OLED, PMOS transistors M1 through M5, and capacitors C1 and C2. The transistor is preferably a thin film transistor having a gate electrode, a drain electrode, and a source electrode formed on the glass substrate as a control electrode and two main electrodes.

Transistor M1 has a source coupled to power supply voltage VDD, and a gate coupled to transistor M5, and transistor M3 is coupled between the gate and a drain of transistor M1. Transistor M1 outputs current $I_{OLED}$ corresponding to a voltage $V_{GS}$ at the gate and the source thereof. Transistor M3 diode-connects transistor M1 in response to a control signal $CS1_n$ from scan line $X_n$. Capacitor C1 is coupled between power supply voltage VDD and the gate of transistor M1, and capacitor C2 is coupled between power supply voltage VDD and a first end of transistor M5. Capacitors C1 and C2 operate as storage elements for storing the voltage between the gate and the source of the transistor. A second end of transistor M5 is coupled to the gate of transistor M1, and transistor M5 couples capacitors C1 and C2 in response to a control signal $CS2_n$ from scan line $Y_n$.

Transistor M2 transmits data current $I_{DATA}$ from transistor M1 to data line $D_m$ in response to a select signal $SE_n$ from scan line $S_n$. Transistor M4 coupled between the drain of transistor M1 and the OLED, transmits current $I_{OLED}$ of transistor M1 to the OLED in response to an emit signal $EM_n$ of scan line $E_n$. The OLED is coupled between transistor M4 and the reference voltage, and emits light corresponding to applied current $I_{OLED}$.

Referring to FIG. 6, an operation of the pixel circuit according to the first embodiment of the present invention will now be described in detail.

As shown, in interval T1, transistor M5 is turned on because of low-level control signal $CS2_n$, and capacitors C1 and C2 are coupled in parallel between the gate and the source of transistor M1. Transistor M3 is turned on because of low-level control signal $CS1_n$ transistor M1 is diode-connected, and the threshold voltage $V_{TH}$ of transistor M1 is stored in capacitors C1 and C2 coupled in parallel because of diode-connected transistor M1. Transistor M4 is turned off because of high-level emit signal $EM_n$, and the current to the OLED is intercepted. That is, in interval T1, the threshold voltage $V_{TH}$ of transistor M1 is sampled to capacitors C1 and C2.

In interval T2, control signal $CS2_n$ becomes high level to turn off transistor M5, and select signal $SE_n$ becomes low level to turn on transistor M2. Capacitor C2 is floated while charged with voltage, because of turned-off transistor M5. Data current $I_{DATA}$ from transistor M1 flows to data line Dm because of turned-on transistor M2. Accordingly, the gate-source voltage $V_{GS}$ (T2) at transistor M1 is determined corresponding to data current $I_{DATA}$, and the gate-source voltage $V_{GS}$ (T2) is stored in capacitor C1. Since data current $I_{DATA}$ flows from transistor M1, data current $I_{DATA}$ can be expressed as Equation 3, and the gate-source voltage $V_{GS}$ (T2) in interval T2 is given as Equation 4 derived from Equation 3. That is, the gate-source voltage corresponding to data current $I_{DATA}$ is programmed to capacitor C1 of the pixel circuit in interval T2.

$$I_{DATA}=\beta/2(|V_{GS}(T2)|-|V_{TH}|)^2 \quad \text{Equation 3}$$

$$|V_{GS}(T2)| = \sqrt{\frac{2I_{DATA}}{\beta}} + |V_{TH}| \quad \text{Equation 4}$$

where β is a constant.

Next, in interval T3, transistors M3 and M2 are turned off in response to high-level control signal $CS1_n$ and select signal $SE_n$, and transistors M5 and M4 are turned on because of low-level control signal $CS2_n$ and emit signal $EM_n$. When transistor M5 is turned on, the gate-source voltage $V_{GS}$(T3) at transistor M1 in interval T3 becomes Equation 5 because of coupling of capacitors C1 and C2.

$$|V_{GS}(T3)| = |V_{TH}| + \frac{C_1}{C_1 + C_2}(|V_{GS}(T2)| - |V_{TH}|) \quad \text{Equation 5}$$

where C1 and C2 are respectively the capacitance of capacitors C1 and C2.

Therefore, current $I_{OLED}$ flowing to transistor M1 becomes as Equation 6, and current $I_{OLED}$ is supplied to the OLED because of turned-on transistor M4, to thereby-emit light. That is, in interval T3, the voltage is provided and the OLED emits light because of coupling of capacitors C1 and C2.

$$I_{OLED} = \frac{\beta}{2}\left\{\frac{C_1}{C_1 + C_2}(|V_{GS}(T2)| - |V_{TH}|)\right\}^2 = \left(\frac{C_1}{C_1 + C_2}\right)^2 I_{DATA} \quad \text{Equation 6}$$

As expressed in Equation 6, since current $I_{OLED}$ supplied to the OLED is determined with no relation to the threshold voltage $V_{TH}$ of transistor M1 or the mobility, the deviation of the threshold voltage or the deviation of the mobility can be corrected. Also, current $I_{OLED}$ supplied to the OLED is C1/(C1+C2) squared times smaller than the data current $I_{DATA}$. For example, if C2 is M times greater than C1 (C2=M×C1), the fine current flowing to the OLED can be controlled by data current $I_{DATA}$ which is (M+1)2 times greater than current $I_{OLED}$, thereby enabling representation of high gray. Further, since the large data current $I_{DATA}$ is supplied to data lines $D_1$ through $D_m$, charging time for the data lines can be sufficiently obtained.

In the first embodiment, PMOS transistors are used for transistors M1 through M5. However, NMOS transistors can also be implemented, which will now be described referring to FIGS. 7 and 8.

Figure 7:
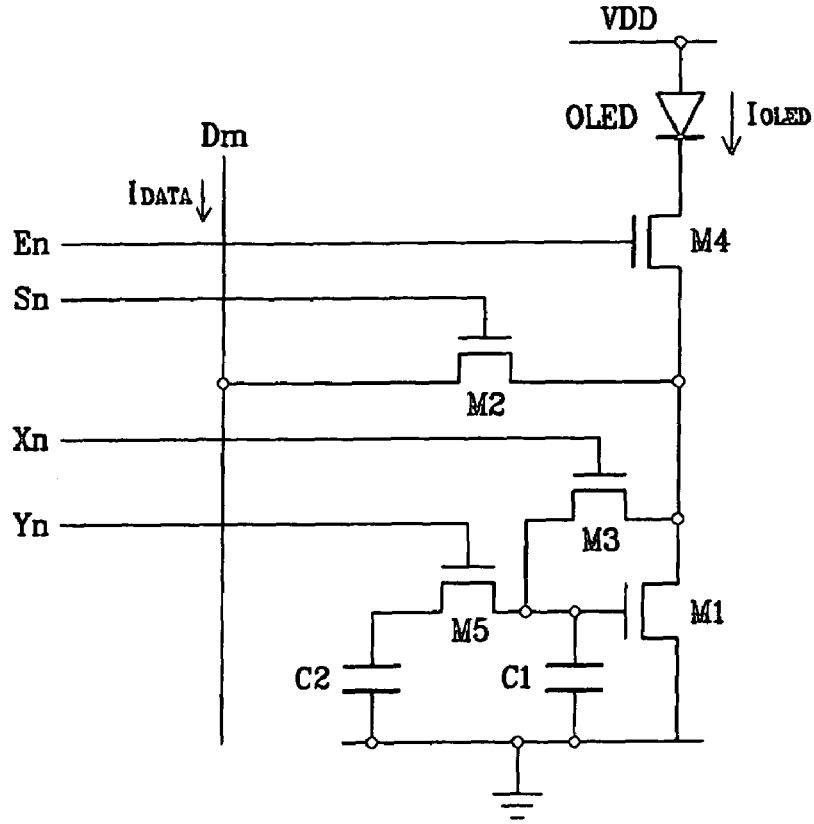
Figure 8:
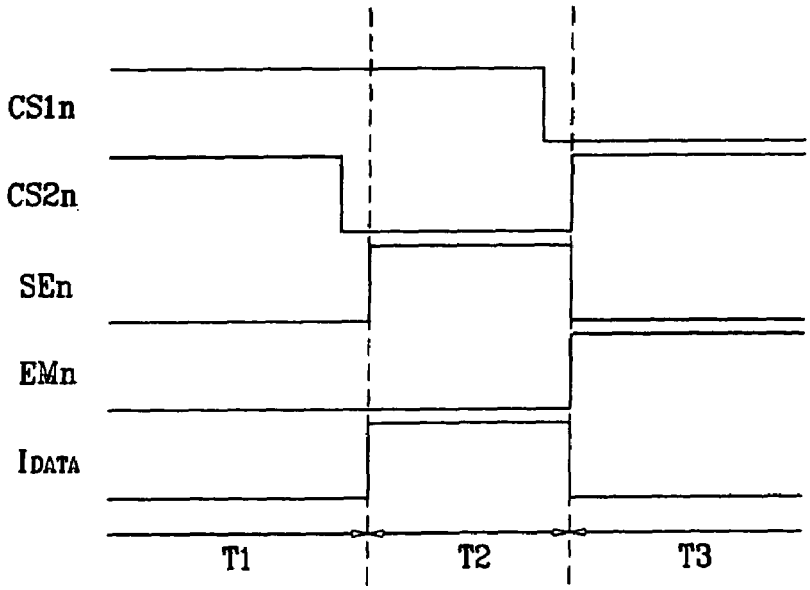

FIG. 7 shows an equivalent circuit diagram of the pixel circuit according to a second embodiment of the present invention, and FIG. 8 shows a driving waveform diagram for driving the pixel circuit of FIG. 7.

The pixel circuit of FIG. 7 includes NMOS transistors M1 through M5, and their coupling structure is symmetric with the pixel circuit of FIG. 5. In detail, transistor M1 has a source coupled to the reference voltage, a gate coupled to transistor M5, and transistor M3 is coupled between the gate and a drain of transistor M1. Capacitor C1 is coupled between the reference voltage and the gate of transistor M1, and capacitor C2 is coupled between the reference voltage and a first end of transistor M5. A second end of transistor M5 is coupled to the gate of transistor M1, and control signals $CS1_n$ and $CS2_n$ from scan lines $X_n$ and $Y_n$ are respectively applied to the gates of transistors M3 and M5. Transistor M2 transmits data current $I_{DATA}$ from data line $D_m$ to transistor M1 in response to select signal $SE_n$ from scan line $S_n$. Transistor M4 is coupled between the drain of transistor M1 and the OLED, and emit signal $EM_n$ from scan line $E_n$ is applied to the gate of transistor M4. The OLED is coupled between transistor M4 and power supply voltage VDD.

Since the pixel circuit of FIG. 7 includes NMOS transistors, the driving waveform for driving the pixel circuit of FIG. 7 has an inverse form of the driving waveform of FIG. 6, as shown in FIG. 8. Since the detailed operation of the pixel circuit according to the second embodiment of the present invention can be easily obtained from the description of the first embodiment and FIGS. 7 and 8, no further detailed description will be provided.

According to the first and second embodiments, since transistors M1 through M5 are the same type transistors, a process for forming TFTS on the glass substrate of display panel 10 can be easily executed.

Transistors M1 through M5 are PMOS or NMOS types in the first and second embodiments, but without being restricted to this, they can be realized using combination of PMOS and NMOS transistors, or other switches having similar functions.

Two control signals $CS1_n$ and $CS2_n$ are used to control the pixel circuit in the first and second embodiments, and in addition, the pixel circuit can be controlled using a single control signal, which will now be described with reference to FIGS. 9 through 12.

Figure 9:
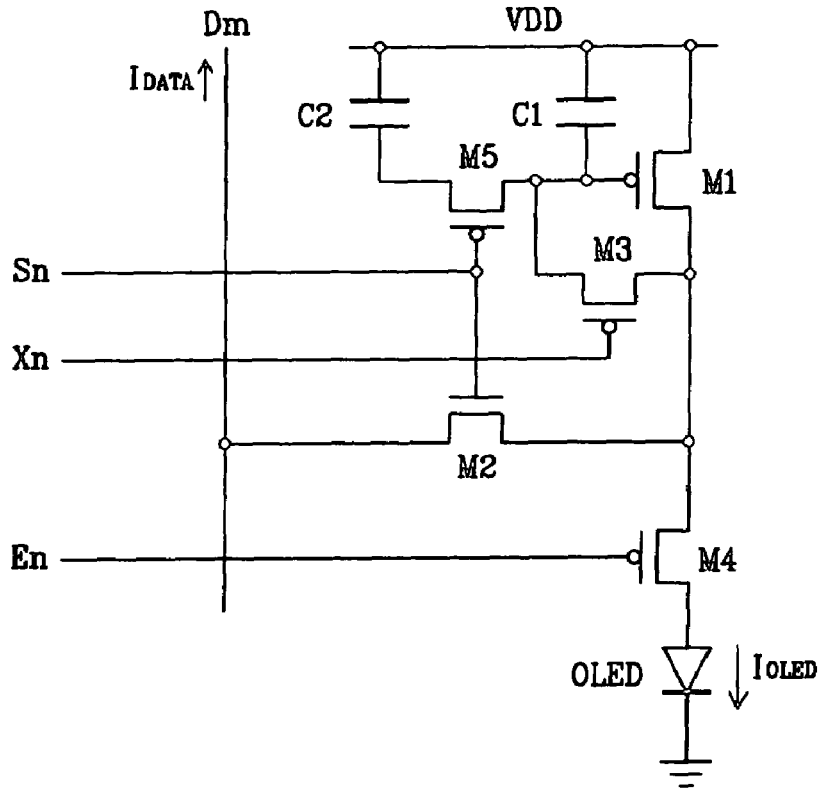
Figure 10:
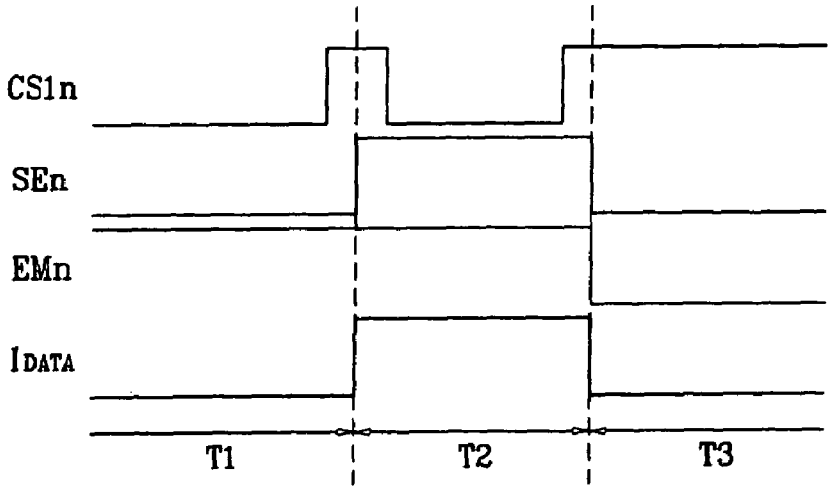

FIG. 9 shows an equivalent circuit diagram of the pixel circuit according to a third embodiment of the present invention, and FIG. 10 shows a driving waveform diagram for driving the pixel circuit of FIG. 9.

As shown in FIG. 9, the pixel circuit has the same configuration as the first embodiment except for transistors M2 and M5. Transistor M2 includes an NMOS transistor, and gates of transistors M2 and M5 are coupled in common to scan line $S_n$. That is, transistor M5 is driven by select signal $SE_n$ from scan line $S_n$.

Referring to FIG. 10, in interval T1, transistors M3 and M5 are turned on because of low-level control signal $CS1_n$ and select signal $SE_n$. Transistor M1 is diode-connected because of turned-on transistor M3, and the threshold voltage $V_{TH}$ at transistor M1 is stored in capacitors C1 and C2. Also, transistor M4 is turned off because of high-level emit signal $EM_n$, and the current flow to the OLED is intercepted.

In interval T2, select signal $SE_n$ becomes high level to turn transistor M2 on and transistor M5 off. Then, the voltage $V_{GS}$ (T2) expressed in Equation 4 is charged in capacitor C1. In this instance, since the voltage charged in capacitor C2 can be changed when transistor M2 is turned on because of select signal $SE_n$, in order to prevent this, transistor M3 is turned off before transistor M2 is turned on, and again, transistor M3 is turned on after transistor M2 is turned on. That is, control signal $CS1_n$ is inverted to high level for a short time before select signal $SE_n$ becomes high level.

Since other operations in the third embodiment of the present invention are matched with those of the first embodiment, no further corresponding description will be provided. According to the third embodiment, scan lines $Y_1$ through $Y_n$ for supplying control signal $CS2_n$ can be removed, thereby increasing the aperture ratio of the pixels.

In the third embodiment, transistors M1 and M3 through M5 are realized with PMOS transistors, and transistor M2 with an NMOS transistor, and further, the opposite realization of the transistors are possible, which will be described with reference to FIGS. 11 and 12.

Figure 11:
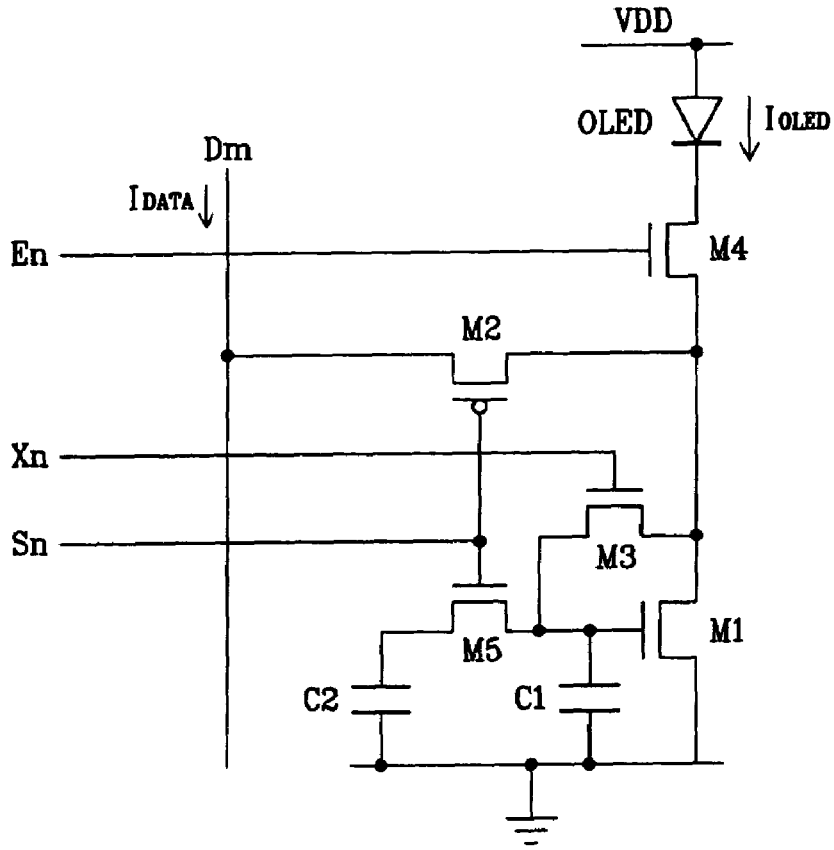
Figure 12:
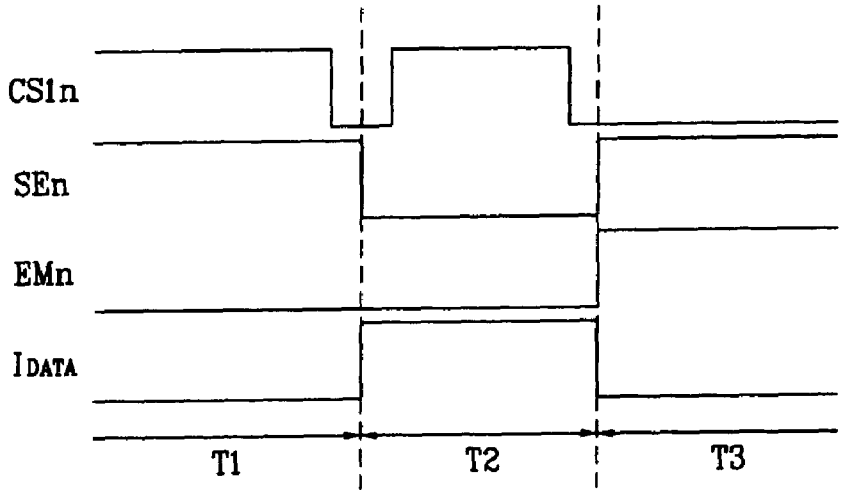

FIG. 11 shows an equivalent circuit diagram of the pixel circuit according to a fourth embodiment of the present invention, and FIG. 12 shows a driving waveform diagram for driving the pixel circuit of FIG. 11.

As shown in FIG. 11, the pixel circuit realizes transistor M2 with a PMOS transistor, and transistors M1 and M3 through M5 with NMOS transistors, and their coupling structure is symmetric with that of the pixel circuit of FIG. 9. Also, as shown in FIG. 12, the driving waveform for driving the pixel circuit of FIG. 11 has an inverse form of that of FIG. 10. Since the coupling structure and the operation of the pixel circuit according to the fourth embodiment can be easily obtained from the description of the third embodiment, no detailed description will be provided.

In the first through fourth embodiments, capacitors C1 and C2 are coupled in parallel to power supply voltage VDD, and differing from this, capacitors C1 and C2 can be coupled in series to power supply voltage VDD, which will now be described referring to FIGS. 13 and 14.

Figure 13:
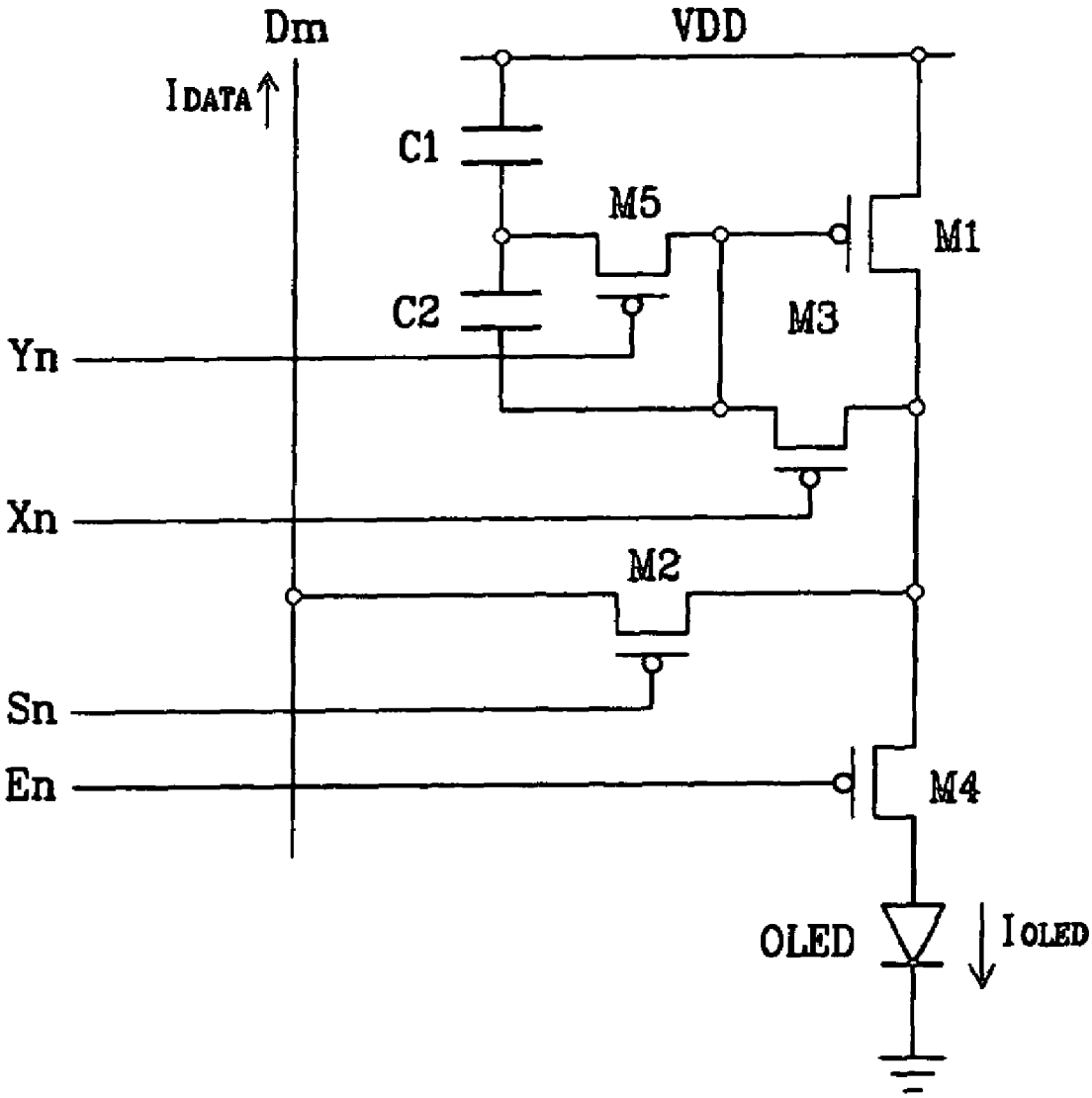

FIG. 13 shows an equivalent circuit diagram of the pixel circuit according to a fifth embodiment of the present invention.

As shown, the pixel circuit has the same structure as that of the first embodiment except for the coupling states of capacitors C1 and C2, and transistor M5. In detail, capacitors C1 and C2 are coupled in series between power supply voltage VDD and transistor M3, and transistor M5 is coupled between the common node of capacitors C1 and C2 and the gate of transistor M1.

The pixel circuit according to the fifth embodiment is driven with the same driving waveform as that of the first embodiment, which will now be described referring to FIGS. 6 and 13.

In interval T1, transistor M3 is turned on because of low-level control signal $CS1_n$ to diode-connect transistor M1. The threshold voltage $V_{TH}$ of transistor M1 is stored in capacitor C1 because of diode-connected transistor M1, and the voltage at capacitor C2 becomes 0V. Also, transistor M4 is turned off because of high-level emit signal $EM_n$ to intercept the current flow to the OLED.

In interval T2, control signal $CS2_n$ becomes high level to turn off transistor M5, and select $SE_n$ becomes low level to turn on transistor M2. Data current $I_{DATA}$ flows from transistor M1 to data line $D_m$ because of turned-on transistor M2, and the gate-source voltage $V_{GS}$ (T2) at transistor M1 becomes as shown in Equation 4. Hence, the voltage $V_{C1}$ at capacitor C1 charging the threshold voltage $V_{TH}$ becomes as shown in Equation 7 because of coupling of capacitors C1 and C2.

$$V_{C1} = |V_{TH}| + \frac{C_2}{C_1 + C_2}(|V_{GS}(T2)| - |V_{TH}|) \quad \text{Equation 7}$$

Next, in interval T3, transistors M3 and M2 are turned off in response to high-level control signal $CS1_n$ and select signal $SE_n$, and transistors M5 and M4 are turned on because of low-level control signal $CS2_n$ and emit signal $EM_n$. When transistor M3 is turned off, and transistor M5 is turned on, the voltage $V_{C1}$ at capacitor C1 becomes the gate-source voltage $V_{GS}$ (T3) of transistor M1. Therefore, current $I_{OLED}$ flowing from transistor M1 becomes as shown in Equation 8, and current $I_{OLED}$ is supplied to the OLED according to transistor M4 thereby emitting light.

$$I_{OLED} = \frac{\beta}{2}\left\{\frac{C_2}{C_1 + C_2}(|V_{GS}(T2)| - |V_{TH}|)\right\}^2 = \left(\frac{C_2}{C_1 + C_2}\right)^2 I_{DATA} \quad \text{Equation 8}$$

In the like manner of the first embodiment, current $I_{OLED}$ supplied to the OLED is determined with no relation to the threshold voltage $V_{TH}$ of transistor M1 or the mobility. Also, since the fine current flowing to the OLED using data current $I_{DATA}$ that is (C1+C2)/C2 squared times current $I_{OLED}$ can be controlled, high gray can be represented. By supplying large data current $I_{DATA}$ to data lines $D_1$ through $D_M$, sufficient charging time of the data lines can be obtained.

Transistors M1 through M5 are realized with PMOS transistors in the fifth embodiment, and they can also be realized with NMOS transistors, which will now be described with reference to FIG. 14.

Figure 14:
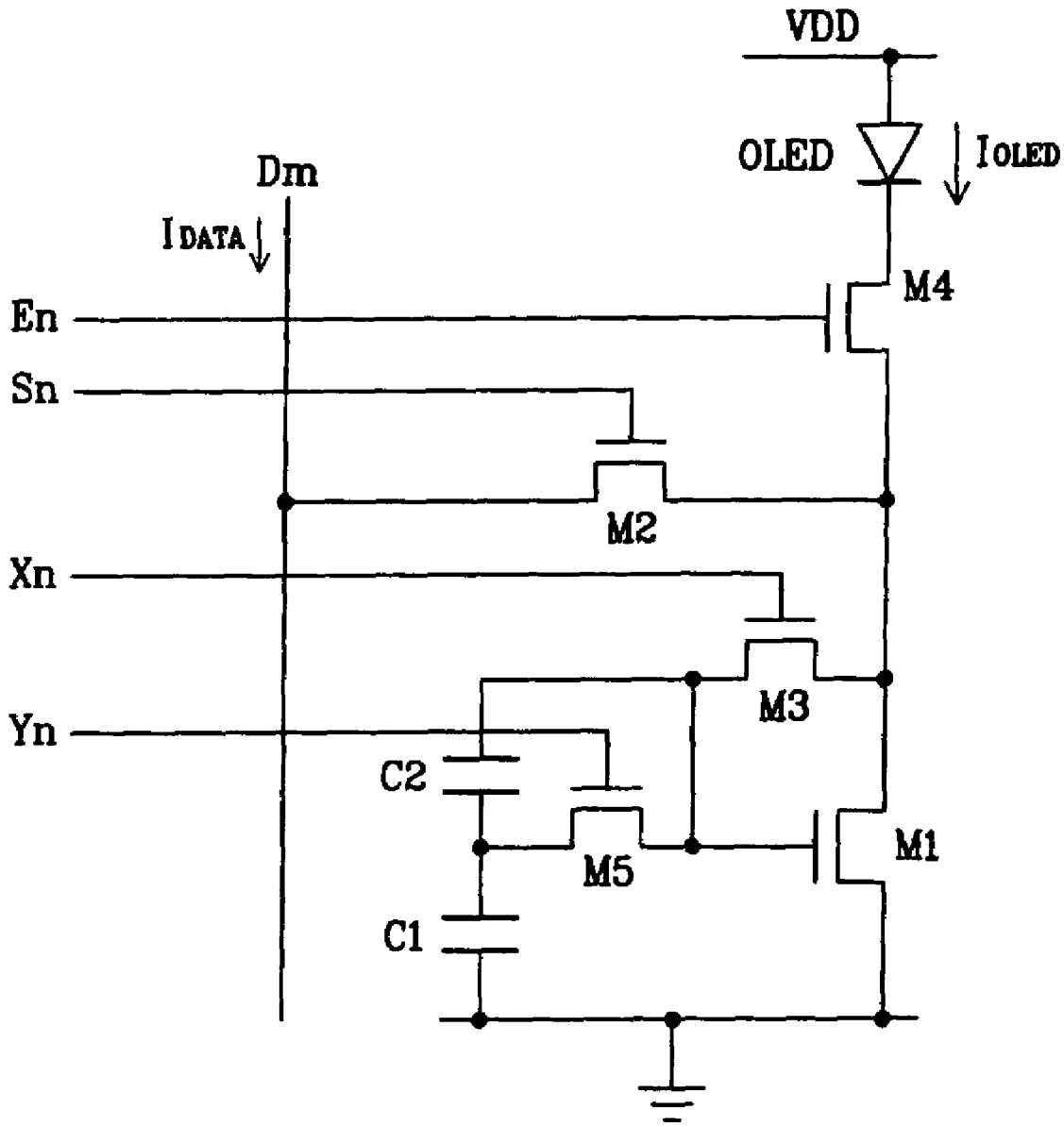

FIG. 14 shows an equivalent circuit diagram of the pixel circuit according to a sixth embodiment of the present invention.

As shown, the pixel circuit realizes transistors M1 through M5 with NMOS transistors, and their coupling structure is symmetric with that of the pixel circuit of FIG. 13. The driving waveform for driving the pixel circuit of FIG. 14 has an inverse driving waveform of the pixel circuit of FIG. 14, and it is the same driving waveform as that of FIG. 8. Since the coupling structure and the operation of the pixel circuit according to the sixth embodiment can be easily derived from the description of the fifth embodiment, no further detailed description will be provided.

Two or one control signal is used to control the pixel circuit in the first through sixth embodiments, and differing from this, the pixel circuit can be controlled by using a select signal of a previous scan line without using the control signal, which will now be described in detail with reference to FIGS. 15 and 16.

Figure 15:
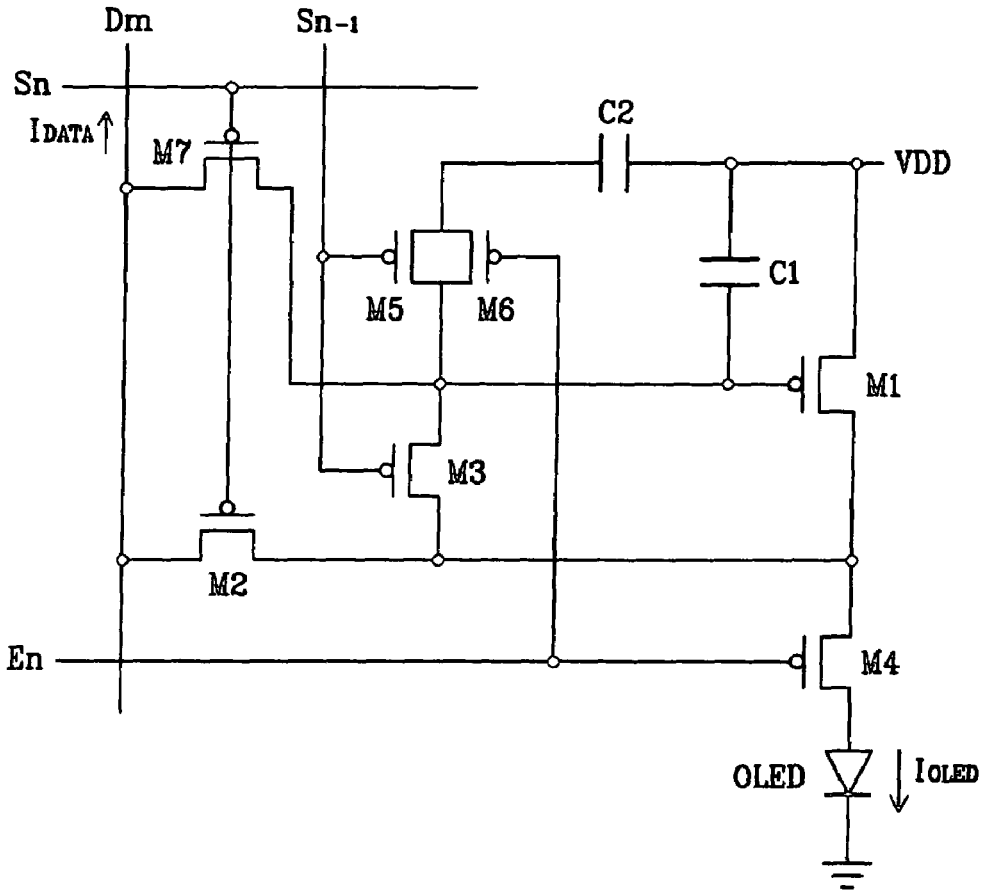
Figure 16:
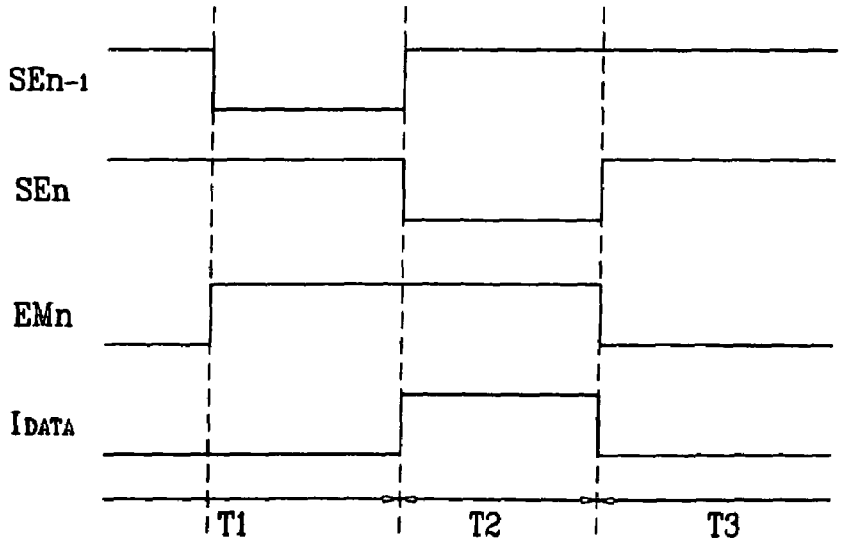

FIG. 15 shows an equivalent circuit diagram of the pixel circuit according to a seventh embodiment of the present invention, and FIG. 16 shows a driving waveform diagram for driving the pixel circuit of FIG. 15.

As shown in FIG. 15, the pixel circuit has the same structure as that of the first embodiment except for transistors M3, M5, M6, and M7. In detail, transistor M3 diode-connects transistor M1 in response to select signal $SE_{n-1}$ from previous scan line $S_{n-1}$, and transistor M7 diode-connects transistor M1 in response to select signal $SE_n$ from current scan line $S_n$. Transistor M7 is coupled between data line $D_m$ and the gate of transistor M1 in FIG. 15, and it can also be coupled between the gate and the drain of transistor M1. Transistors M5 and M6 are coupled in parallel between capacitor C2 and the gate of transistor M1. Transistor M5 responds to select signal $SE_{n-1}$ from previous scan line $S_{n-1}$, and transistor M6 responds to emit signal $EM_n$ from scan line $E_n$.

Next, the operation of the pixel circuit of FIG. 15 will be described referring to FIG. 16.

As shown, in interval T1, transistors M3 and M5 are turned on because of low-level select signal $SE_{n-1}$. Capacitors C1 and C2 are coupled in parallel between the gate and the source of transistor M1 because of turned-on transistor M5. Transistor M1 is diode-connected because of turned-on transistor M3 to store the threshold voltage $V_{TH}$ of transistor M1 in capacitors C1 and C2 coupled in parallel. Transistors M2, M7, M4, and M6 are turned off because of high-level select signal $SE_n$ and emit signal $EM_n$.

In interval T2, select signal $SE_{n-1}$ becomes high level to turn off transistor M3, and transistor M7 is turned on because of low-level select signal $SE_n$ to diode-connect transistor M1 and maintain the diode-connected state of transistor M1. Transistor M5 is turned off because of select signal $SE_{n-1}$ to have capacitor C2 be floated while storing the voltage. Transistor M2 is turned on because of select signal $SE_n$ to make data current $I_{DATA}$ from transistor M1 flow to data line $D_m$. The gate-source voltage $V_{GS}$ (T2) of transistor M1 is determined corresponding to data current $I_{DATA}$, and the gate-source voltage $V_{GS}$ (T2) is given as Equation 4 in the same manner of the first embodiment.

Next, in interval T3, select signal $SE_n$ becomes high level to turn off transistors M2 and M7, and transistors M4 and M6 are turned on because of low-level emit signal $EM_n$. When transistor M6 is turned on, the gate-source voltage $V_{GS}$ (T3) of transistor M1 is given as Equation 5 because of coupling of capacitors C1 and C2 in the like manner of the first embodiment. Therefore, current $I_{OLED}$ shown in Equation 6 is supplied to the OLED because of turned-on transistor M4 to emit light.

The two control signals $CS1_n$ and $CS2_n$ are removed in the seventh embodiment, and differing from this, one of control signals $CS1_n$ and $CS2_n$ can be removed. In detail, in the case of additionally using control signal $CS1_n$ in the seventh embodiment, transistor M7 is removed from the pixel circuit of FIG. 15, and transistor M3 is driven by not select signal $SE_{n-1}$ but by control signal $CS1_n$. In the case of additionally using control signal $CS2_n$ in the seventh embodiment, transistor M6 is removed from the pixel circuit of FIG. 15, and transistor M5 is not driven by the select signal $SE_{n-1}$ and emit signal $EM_n$ but by control signal $CS2_n$. Accordingly, the number of wires increases compared to FIG. 15, but the number of transistors can be reduced.

In the above, PMOS and/or NMOS transistors are used to realize a pixel circuit in the first through seventh embodiments, and without being restricted to this, the pixel circuit can be realized by PMOS transistors, NMOS transistors, or a combination of PMOS and NMOS transistors, and by other switches having similar functions.

Accordingly, since the current flowing to the OLED can be controlled using the large data current, the data line can be sufficiently charged during a single line time frame. Also, the deviation of the threshold voltage of the transistor or the deviation of the mobility is corrected, and a light emission display with high resolution and a wide screen can be realized.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A display comprising:

a data line for transmitting a data current;

a first scan line for applying a select signal;

a second scan line for applying an emission control signal;

a first signal line for applying a first control signal;

a second signal line for applying a second control signal;

a first transistor having a first electrode coupled to a first voltage source for supplying a first voltage;

a second transistor coupled between the data line and a second electrode of the first transistor and having a control electrode coupled to the first scan line;

a third transistor having a control electrode coupled to the first signal line, a first electrode coupled to the second electrode of the first transistor, and a second electrode coupled to a control electrode of the first transistor;

an emitting element having a cathode coupled to a second voltage source for supplying a second voltage which is lower than the first voltage;

a fourth transistor coupled between the second electrode of the first transistor and an anode of the emitting element and having a control electrode coupled to the second scan line;

a first capacitor coupled between the first electrode of the first transistor and the control electrode of the first transistor;

a second capacitor having a first electrode coupled to a first electrode of the first capacitor; and a fifth transistor coupled between a second electrode of the first capacitor and a second electrode of the second capacitor and having a control electrode coupled to the second signal line.

2. The display of claim 1, wherein the first electrode of the first capacitor is coupled to the first electrode of the first transistor.

3. The display of claim 1, wherein the first to fifth transistors are PMOS transistors.

4. The display of claim 3, wherein the first control signal and the second control signal respectively have low levels and the select signal and the emission control signal respectively have high levels, in a first period, wherein the first control signal and the select signal respectively have low levels and the second control signal and the emission control signal respectively have high levels, in a second period after the first period, and wherein the second control signal and the emission control signal respectively have low levels and the first control signal and the select signal respectively have high levels, in a third period after the second period.

5. A display comprising:

a data line for transmitting a data current;

a first scan line for applying a select signal;

a second scan line for applying an emission control signal;

a first signal line for applying a first control signal;

a second signal line for applying a second control signal;

a first transistor having a first electrode coupled to a first voltage source for supplying a first voltage;

a second transistor coupled between the data line and a second electrode of the first transistor and having a control electrode coupled to the first scan line;

a third transistor having a control electrode coupled to the first signal line, a first electrode coupled to the second electrode of the first transistor, and a second electrode coupled to a control electrode of the first transistor;

an emitting element having an anode coupled to a second voltage source for supplying a second voltage which is higher than the first voltage;

a fourth transistor coupled between the second electrode of the first transistor and a cathode of the emitting element and having a control electrode coupled to the second scan line;

a first capacitor coupled between the first electrode of the first transistor and the control electrode of the first transistor;

a second capacitor having a first electrode coupled to a first electrode of the first capacitor; and a fifth transistor coupled between a second electrode of the first capacitor and a second electrode of the second capacitor and having a control electrode coupled to the second signal line.

6. The display of claim 5, wherein the first electrode of the first capacitor is coupled to the first electrode of the first transistor.

7. The display of claim 5, wherein the first to fifth transistors are NMOS transistors.

8. The display of claim 7, wherein the first control signal and the second control signal respectively have high levels and the select signal and the emission control signal respectively have low levels, in a first period, wherein the first control signal and the select signal respectively have high levels and the second control signal and the emission control signal respectively have low levels, in a second period after the first period, and wherein the second control signal and the emission control signal respectively have high levels and the first control signal and the select signal respectively have low levels, in a third period after the second period.

9. A display comprising:

a data line for transmitting a data current;

a first scan line for applying a select signal;

a second scan line for applying an emission control signal;

a signal line for applying a control signal;

a first transistor having a first electrode coupled to a first voltage source for supplying a first voltage;

a second transistor coupled between the data line and a second electrode of the first transistor and having a control electrode coupled to the first scan line;

a third transistor having a control electrode coupled to the signal line, a first electrode coupled to the second electrode of the first transistor, and a second electrode coupled to a control electrode of the first transistor;

an emitting element having a cathode coupled to a second voltage source for supplying a second voltage which is lower than the first voltage;

a fourth transistor coupled between the second electrode of the first transistor and an anode of the emitting element and having a control electrode coupled to the second scan line;

a first capacitor coupled between the first electrode of the first transistor and the control electrode of the first transistor;

a second capacitor having a first electrode coupled to a first electrode of the first capacitor; and a fifth transistor coupled between a second electrode of the first capacitor and a second electrode of the second capacitor and having a control electrode coupled to the first scan line.

10. The display of claim 9, wherein the first electrode of the first capacitor is coupled to the first electrode of the first transistor.

11. The display of claim 9, wherein the first, third, fourth and fifth transistors are PMOS transistors, and the second transistor is an NMOS transistor.

12. The display of claim 11, wherein the control signal and the select signal respectively have low levels and the emission control signal has high level, in a first period, wherein the control signal has low level and the select signal and the emission control signal respectively have high levels, in a second period after the first period, and wherein the select signal and the emission control signal respectively have low levels and the control signal has high level, in a third period after the second period.

13. The display of claim 12, wherein the level of the select signal is changed from low level to high level while the control signal has high level, in a fourth period between the first period and the second period.

14. A display comprising:

a data line for transmitting a data current;

a first scan line for applying a select signal;

a second scan line for applying an emission control signal;

a signal line for applying a control signal;

a first transistor having a first electrode coupled to a first voltage source for supplying a first voltage;

a second transistor coupled between the data line and a second electrode of the first transistor and having a control electrode coupled to the first scan line;

a third transistor having a control electrode coupled to the signal line, a first electrode coupled to the second electrode of the first transistor, and a second electrode coupled to a control electrode of the first transistor;

an emitting element having an anode coupled to a second voltage source for supplying a second voltage which is higher than the first voltage;

a fourth transistor coupled between the second electrode of the first transistor and a cathode of the emitting element and having a control electrode coupled to the second scan line;

a first capacitor coupled between the first electrode of the first transistor and the control electrode of the first transistor;

a second capacitor having a first electrode coupled to a first electrode of the first capacitor; and a fifth transistor coupled between a second electrode of the first capacitor and a second electrode of the second capacitor and having a control electrode coupled to the first scan line.

15. The display of claim 14, wherein the first electrode of the first capacitor is coupled to the first electrode of the first transistor.

16. The display of claim 14, wherein the first, third, fourth and fifth transistors are NMOS transistors, and the second transistor is a PMOS transistor.

17. The display of claim 16, wherein the control signal and the select signal respectively have high levels and the emission control signal has low level, in a first period, wherein the control signal has high level and the select signal and the emission control signal respectively have low levels, in a second period after the first period, and wherein the select signal and the emission control signal respectively have high levels and the control signal has low level, in a third period after the second period.

18. The display of claim 17, wherein the level of the select signal is changed from high level to low level while the control signal has low level in a fourth period between the first period and the second period.

19. A display comprising:

a data line for transmitting a data current;

a first scan line for applying a select signal;

a second scan line for applying an emission control signal;

a first signal line for applying a first control signal;

a first transistor having a first electrode coupled to a first voltage source for supplying a first voltage;

a second transistor coupled between the data line and a second electrode of the first transistor and having a control electrode coupled to the first scan line;

a third transistor having a control electrode coupled to the first signal line, a first electrode coupled to the second electrode of the first transistor, and a second electrode coupled to a control electrode of the first transistor;

an emitting element having a cathode coupled to a second voltage source for supplying a second voltage which is lower than the first voltage;

a fourth transistor coupled between the second electrode of the first transistor and an anode of the emitting element and having a control electrode coupled to the second scan line;

a first capacitor having a first electrode coupled to the first electrode of the first transistor;

a second capacitor coupled between a second electrode of the first capacitor and the control electrode of the first transistor; and a fifth transistor coupled between the second electrode of the first capacitor and the control electrode of the first transistor.

20. The display of claim 19, further comprising a second signal line for applying a second control signal, wherein a control electrode of the fifth transistor is coupled to the second signal line.

21. The display of claim 20, wherein the first to fifth transistors are PMOS transistors.

22. The display of claim 21, wherein the first control signal and the second control signal respectively have low levels and the select signal and the emission control signal respectively have high levels, in a first period, wherein the first control signal and the select signal respectively have low levels and the second control signal and the emission control signal respectively have high levels, in a second period after the first period, and wherein the second control signal and the emission control signal respectively have low levels and the first control signal and the select signal respectively have high levels, in a third period after the second period.

23. A display comprising:

a data line for transmitting a data current;

a first scan line for applying a select signal;

a second scan line for applying an emission control signal;

a first signal line for applying a first control signal;

a first transistor having a first electrode coupled to a first voltage source for supplying a first voltage;

a second transistor coupled between the data line and a second electrode of the first transistor and having a control electrode coupled to the first scan line;

a third transistor having a control electrode coupled to the first signal line, a first electrode coupled to the second electrode of the first transistor, and a second electrode coupled to a control electrode of the first transistor;

an emitting element having an anode coupled to a second voltage source for supplying a second voltage which is higher than the first voltage;

a fourth transistor coupled between the second electrode of the first transistor and a cathode of the emitting element and having a control electrode coupled to the second scan line;

a first capacitor having a first electrode coupled to the first electrode of the first transistor;

a second capacitor coupled between a second electrode of the first capacitor and the control electrode of the first transistor; and a fifth transistor coupled between the second electrode of the first capacitor and the control electrode of the first transistor.

24. The display of claim 23, further comprising a second signal line for applying a second control signal, wherein a control electrode of the fifth transistor is coupled to the second signal line.

25. The display of claim 24, wherein the first to fifth transistors are NMOS transistors.

26. The display of claim 25, wherein the first control signal and the second control signal respectively have high levels and the select signal and the emission control signal respectively have low levels, in a first period, wherein the first control signal and the select signal respectively have high levels and the second control signal and the emission control signal respectively have low levels, in a second period after the first period, and wherein the second control signal and the emission control signal respectively have high levels and the first control signal and the select signal respectively have low levels, in a third period after the second period.

27. A display comprising:

a data line for transmitting a data current;

a first scan line for applying a select signal;

a second scan line for applying an emission control signal;

a signal line for applying a control signal;

a first transistor having a first electrode coupled to a first voltage source for supplying a first voltage;

a second transistor coupled between the data line and a second electrode of the first transistor and having a control electrode coupled to the first scan line;

a third transistor having a control electrode coupled to the signal line, a first electrode coupled to the second electrode of the first transistor, and a second electrode coupled to a control electrode of the first transistor;

an emitting element having a first electrode coupled to a second voltage source for supplying a second voltage;

a fourth transistor coupled between the second electrode of the first transistor and a second electrode of the emitting element and having a control electrode coupled to the second scan line;

a first capacitor coupled between the first electrode of the first transistor and the control electrode of the first transistor;

a second capacitor having a first electrode coupled to a first electrode of the first capacitor;

a fifth transistor coupled between a second electrode of the first capacitor and a second electrode of the second capacitor and having a control electrode coupled to the signal line;

a sixth transistor coupled between a second electrode of the first capacitor and a second electrode of the second capacitor and having a control electrode coupled to the second scan line; and a seventh transistor having a control electrode coupled to the first scan line, a first electrode coupled to the control electrode of the first transistor, and a second electrode coupled to the data line and/or electrically coupled to the second electrode of the first transistor.

28. The display of claim 27, wherein the first electrode of the first capacitor is coupled to the first electrode of the first transistor.

29. The display of claim 27, wherein the first electrode and the second electrode of the emitting element are a cathode and an anode, respectively, and the second voltage is lower than the first voltage.

30. The display of claim 29, wherein the first to seventh transistors are PMOS transistors.

31. The display of claim 30, wherein the control signal has low level and the select signal and the emission control signal respectively have high levels, in a first period, wherein the control signal and the emission control signal respectively have high levels and the select signal has low level, in a second period after the first period, and wherein the control signal and the select signal respectively have high levels and the emission control signal has low level, in a third period after the second period.

32. The display of claim 31, wherein the control signal is a select signal having low level in the first period.

* * * * *